United States Patent [19]

Tsukagoshi et al.

[11] 4,395,814

[45] Aug. 2, 1983

[54] ACOUSTIC VIBRATING ELEMENT OF GRAPHITE AND METHOD OF MANUFACTURING SAME

[75] Inventors: Tsunehiro Tsukagoshi; Teruo Tohma; Shinichi Yokozeki, all of Tokyo, Japan

[73] Assignee: Pioneer Electronic Corporation, Tokyo, Japan

[21] Appl. No.: 315,564

[22] Filed: Oct. 27, 1981

Related U.S. Application Data

[63] Continuation of Ser. No. 880,747, Feb. 24, 1978, abandoned.

[30] Foreign Application Priority Data

Feb. 28, 1977 [JP] Japan ..... 52/20192

[51] Int. Cl.[3] ..... H04R 31/00

[52] U.S. Cl. ..... 29/594; 181/167; 423/445; 423/448; 423/458

[58] Field of Search ..... 423/448, 445, 458; 181/157, 166, 296; 264/29.1; 427/249; 29/594

[56] References Cited

U.S. PATENT DOCUMENTS

| | | | |
|---|---|---|---|
| 3,138,435 | 6/1964 | Diefendorf | 423/448 X |
| 3,297,406 | 1/1967 | Diefendorf | 423/448 X |
| 3,410,746 | 11/1968 | Turkat et al. | 423/448 X |
| 3,720,499 | 3/1973 | Hirayama et al. | 423/448 |
| 4,254,184 | 3/1981 | Tsukagoshi et al. | 264/134 X |

*Primary Examiner*—Edward J. Meros

*Attorney, Agent, or Firm*—Sughrue, Mion, Zinn, Macpeak and Seas

[57] ABSTRACT

An acoustic vibrating element, such a domed speaker diaphragm A or a phonographic pickup cantilever B, is formed by vapor deposition on an easily separable mold member 5 of tantalum or tantalum alloy when a mixture of a hydrocarbon gas and an inert gas is passed through a furnace heated to a temperature of 1150° C.–1250° C. at a flow rate in excess of 200 cm/min. The c-axis crystalline orientation of the resulting graphite element is substantially perpendicular to its surface, which provides a Young's modulus above 16,000 Kg/cm$^2$.

5 Claims, 2 Drawing Figures

ACOUSTIC VIBRATING ELEMENT OF GRAPHITE AND METHOD OF MANUFACTURING SAME

This is a continuation of application Ser. No. 880,747, filed Feb. 24, 1978, now abandoned.

BACKGROUND OF THE INVENTION

This invention relates to acoustic vibrating elements such as the diaphragms in loudspeakers or microphones and the cantilevers in phonographic pick-up cartridges, and to a method of manufacturing such elements from carbon.

Heretofore, aluminum and titanium have been commonly employed as materials for manufacturing electroacoustic transducers of this type. Although these materials have a high workability factor and low densities $\rho$, 2.69 and 4.54 for aluminum and titanium, respectively, since they do not have a very high Young's modulus E it is difficult to manufacture high performance diaphragms from them.

On the other hand, beryllium and boron have a high Young's modulus E and low densities $\rho$, and thus have a high relative modulus of elasticity $E/\rho$. These materials have thus been commonly employed to produce high performance diaphragms. As beryllium is poisonous, however, there are considerable environmental risks during manufacture, and the necessary equipment and safeguards for preventing such risks are quite expensive. Beryllium also has poor workability, whereby vibrating elements made thereof are very costly. Boron, on the other hand, is relatively brittle and thus low in mechanical strength, and has a low workability factor. Furthermore, it is difficult to obtain high purity boron. Accordingly, as in the case of beryllium, the cost of manufacturing boron vibrating elements is relatively high.

SUMMARY OF THE INVENTION

Accordingly, an object of this invention is to eliminate the above-described drawbacks by providing an acoustic vibrating element of crystalline oriented carbon which has an excellent high frequency response characteristic due to a high relative modulus of elasticity, a good transient characteristic, and a flat frequency response owing to a high internal loss characteristic. The cost of such vibrating elements is relatively low because the material thereof is carbon, which is inexpensive, and the cost of the manufacturing equipment required is also quite low.

DETAILED DESCRIPTION OF THE PREFERRED EMBODIMENTS

Figure 1:
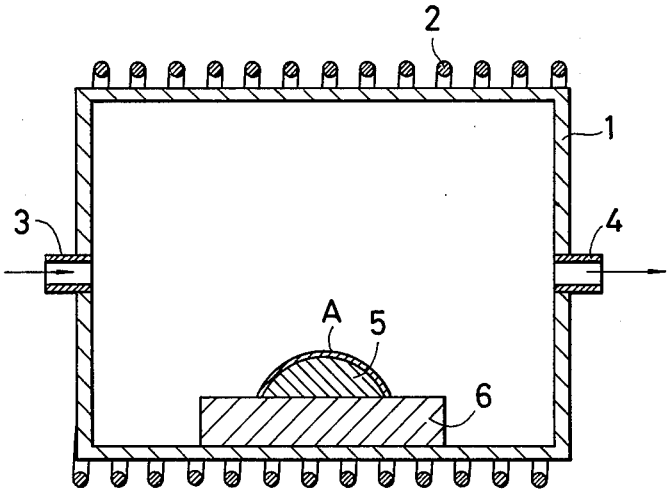
FIG. 1 shows a vertical sectional view of an apparatus for manufacturing a dome-shaped acoustic diaphragm in accordance with the present invention.
Figure 2:
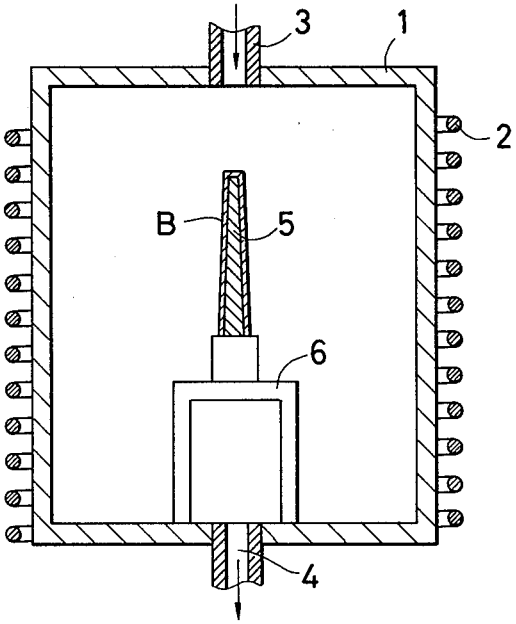
FIG. 2 shows a vertical sectional view of an apparatus for manufacturing a cylindrical cantilever.

FIGS. 1 and 2 illustrate apparatuses for manufacturing a dome-shaped speaker diaphragm A and a cylindrical phonographic pickup arm cantilever B, respectively. Reference numeral 1 designates a high temperature furnace made of a material such as alumina having a high coefficient of heat conductivity. An electrical heater coil 2 is wound around the furnace 1, and reference numerals 3 and 4 respectively designate a gas inlet and outlet provided in the walls of the furnace. A mold box or former 5 made of heat-resisting material such as graphite or tantalum is in the form of a hemisphere in FIG. 1 to manufacture a dome-shaped speaker diaphragm A, and in the form of a tapered cylinder in FIG. 2 to manufacture a cylindrical cantilever B. The configurations of the mold formers 5 thus correspond to those of the vibrating elements A and B to be manufactured. Reference numeral 6 designates a stand for supporting the mold former 5.

The method of manufacturing the vibrating elements will now be described. First, in order to remove oxygen and water which hinder or retard the deposition of carbon, the furnace 1 is evacuated whereafter an inert gas such as argon is introduced through the gas inlet 3. After the pressure in the furnace becomes higher than atmospheric pressure the gas outlet 4 is opened, and the furnace is then heated by energizing the heater coil 2. When the temperature in the furnace reaches 1150°–1250° C. a gaseous phase carbon compound is mixed with the inert gas and the flow rate of the gas mixture through the furnace is adjusted to exceed 200 cm/min. The gaseous phase carbon compound is preferably a gaseous phase hydrocarbon, such as methane, ethane, propan or acetylene. When an unsaturated gaseous phase hydrocarbon is employed, it is preferable to introduce hydrogen gas together with the gaseous phase hydrocarbon or the gas mixture so that the unsaturated gaseous phase hydrocarbon may be converted into a saturated hydrocarbon by adding hydrogen atoms.

As a result the hydrocarbon in the gas mixture is thermally decomposed, and a layer of carbon is gradually and uniformly deposited on the surface of the mold former 5. When the thickness of this carbon layer reaches a desired predetermined value the introduction of the hydrocarbon gas mixture is suspended. After the furnace has cooled down the thus formed carbon element or layer deposited on the surface of the mold former, that is, the diaphragm A or cantilever B, is separated or removed from the mold former. If the mold former is made of tantalum or a tantalum alloy the carbon element can be readily removed because the coefficient of thermal expansion of the mold former differs greatly from that of the carbon element deposited thereon, and because the bonding strength between the carbon element and the tantalum or tantalum alloy is very weak. If the mold former is made of graphite or a mixture having graphite as its major component, the carbon element can also be readily removed due to the difference between the respective coefficients of thermal expansion, i.e. $3.7\text{–}4.4\times10^{-6}$° C.$^{-1}$ for graphite and $1.7\times10^{-6}$° C.$^{-1}$ for the carbon layer.

The c-axis of the resulting graphite crystal diaphragm A or cantilever B is oriented substantially perpendicular to the surface of the element owing to the high flow rate of the gas mixture, its density $\rho$ is accordingly higher than approximately 2.0 to 2.1 g/cm$^3$, and its Young's modulus exceeds 16,000 Kg/mm$^2$.

If the diaphragm A or cantilever B is further subjected to heat treatment in an inert gas atmosphere at a temperature higher than 2000° C. but lower than the melting temperature of graphite, for example in a range of from 2400° C. to 2700° C. for 3 to 60 minutes, the c-axis of the graphite crystal becomes even more perpendicularly oriented to the surface of the element, and hence the Young's modulus increases to above 20,000 $Kg/mm^2$.

As is apparent from the above description, a mixture of a hydrocarbon gas and an inert gas or hydrogen is introduced into a heated furnace at a flow rate higher than 200 cm/min, as a result of which the c-axis of the resulting graphite crystal vibrating element is oriented perpendicular to the surface thereof, and its Young's modulus exeeds 16,000 $Kg/cm^2$. Therefore, if the configuration of a vibrating element according to the invention is made identical with that of a conventional one and the other elements such as a magnetic circuit therefor remain the same, the vibrating element according to the invention has a higher maximum resonance frequency and internal loss characteristic, and a correspondingly flat frequency response curve.

What is claimed is:

1. In a method for producing an electro-acoustic transducer comprising a vibrating member and means for vibrating the vibrating member, the improvement comprising the step of: introducing a mixture of a gaseous carbon compound and an inert gas and/or hydrogen into a furnace; subjecting said mixture to thermal decomposition to thereby deposit a layer of carbon on a surface of a mold former having a desired configuration, wherein the flow rate of said gaseous carbon compound is sufficiently high that the crystallographic c-axis of said layer of carbon is substantially perpendicular to the surface of said layer of carbon; separating said layer of carbon from said mold former to thus obtain said vibrating member; and mounting said vibrating member in a position to be vibrated by said vibrating means.

2. The method of claim 1 wherein said carbon layer has a Young's Modulus above 16,000 $kg/cm^2$.

3. The method of claim 1 wherein, in said step of subjecting said mixture to thermal decomposition, a temperature in a range of 1,150° C. to 1,250° C. is utilized.

4. The method of claim 3 wherein, in said step of introducing said mixture into said furnace, said mixture has a continuous flow rate above 200 cc/min.

5. The method of claim 1 further comprising the step of, following said step of subjecting said mixture to thermal decomposition, subjecting said layer to a heat treatment in an inert gas atmosphere at a temperature in a range of 2400° C. to 2700° C. for a time in a range of 3 to 60 minutes.

* * * * *